US009012800B2

(12) United States Patent
Yamashita et al.

(10) Patent No.: US 9,012,800 B2
(45) Date of Patent: Apr. 21, 2015

(54) GAS CIRCUIT BREAKER

(75) Inventors: Toru Yamashita, Chiyoda-ku (JP); Daisuke Yoshida, Chiyoda-ku (JP); Katsuhiko Horinouchi, Chiyoda-ku (JP); Tatsuya Hayashi, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 234 days.

(21) Appl. No.: 13/511,824

(22) PCT Filed: May 21, 2010

(86) PCT No.: PCT/JP2010/058639

§ 371 (c)(1),
(2), (4) Date: May 24, 2012

(87) PCT Pub. No.: WO2011/096097

PCT Pub. Date: Aug. 11, 2011

(65) Prior Publication Data

US 2012/0261385 A1 Oct. 18, 2012

(30) Foreign Application Priority Data

Feb. 4, 2010 (WO) ..... PCT/JP2010/051560

(51) Int. Cl.
*H01H 33/02* (2006.01)
*H01H 33/70* (2006.01)
*H01H 33/662* (2006.01)

(52) U.S. Cl.
CPC ..... *H01H 33/7015* (2013.01); *H01H 33/7061* (2013.01); *H01H 33/66261* (2013.01)

(58) Field of Classification Search
USPC ..... 218/11, 46, 54, 59
See application file for complete search history.

(56) References Cited

U.S. PATENT DOCUMENTS

| | | | | | |
|---|---|---|---|---|---|
| 4,486,632 | A | * | 12/1984 | Niemeyer et al. | 218/57 |
| 4,650,941 | A | * | 3/1987 | Thuries et al. | 218/59 |
| 4,684,773 | A | * | 8/1987 | Niemeyer | 218/46 |
| 4,716,266 | A | * | 12/1987 | Muscaglione et al. | 218/46 |
| 5,723,840 | A | * | 3/1998 | Bojic et al. | 218/60 |
| 5,902,978 | A | * | 5/1999 | Zehnder et al. | 218/57 |

(Continued)

FOREIGN PATENT DOCUMENTS

| | | | |
|---|---|---|---|
| CN | 1232280 | A | 10/1999 |
| CN | 101111915 | A | 1/2008 |

(Continued)

OTHER PUBLICATIONS

International Search Report (PCT/ISA/210) issued on Jun. 15, 2010, by the Japanese Patent Office as the International Searching Authority for International Application No. PCT/JP2010/058639.

(Continued)

*Primary Examiner* — Truc Nguyen
(74) *Attorney, Agent, or Firm* — Buchanan Ingersoll & Rooney PC

(57) ABSTRACT

A gas circuit breaker is provided, avoiding change in the position of a cover member and without weakening of the blow of gas to the arc in an arc discharge cavity even when a surface of the cover member in contact with the arc discharge cavity is damaged. The gas circuit breaker includes a contact ring, a holder attached to the contact ring, and extending to a path of arc-extinguishing gas that extinguishes an arc, and an electrically insulative cover member attached to the holder.

16 Claims, 7 Drawing Sheets

(56) References Cited

U.S. PATENT DOCUMENTS

| | | | | |
|---|---|---|---|---|
| 5,929,409 | A | 7/1999 | Zehnder et al. | |
| 6,100,489 | A | 8/2000 | Zehnder et al. | |
| 6,100,492 | A | 8/2000 | Zehnder et al. | |
| 6,163,001 | A | 12/2000 | Zehnder et al. | |
| 6,211,478 | B1 | 4/2001 | Schoenemann et al. | |
| 6,259,050 | B1 | 7/2001 | Zehnder et al. | |
| 8,115,133 | B2 * | 2/2012 | Uchii et al. | 218/63 |
| 2002/0060203 | A1 | 5/2002 | Zehnder et al. | |
| 2007/0295693 | A1 | 12/2007 | Saxl et al. | |
| 2008/0006608 | A1 | 1/2008 | Saxl et al. | |
| 2009/0008367 | A1 * | 1/2009 | Kriegel et al. | 218/62 |

FOREIGN PATENT DOCUMENTS

| | | | |
|---|---|---|---|
| CN | 101288141 | A | 10/2008 |
| EP | 0951029 | A2 | 10/1999 |
| JP | 55-161332 | U | 11/1980 |
| JP | 10-31945 | A | 2/1998 |
| JP | 11-329175 | A | 11/1999 |
| JP | 11-329176 | A | 11/1999 |
| JP | 11-329191 | A | 11/1999 |
| JP | 2000-067679 | A | 3/2000 |
| JP | 2002-505797 | A | 2/2002 |
| JP | 2002-203463 | A | 7/2002 |

OTHER PUBLICATIONS

Chinese Office Action dated Apr. 15, 2014 issued in corresponding Chinese Patent Appln. No. 201080061079.9, with English translation (18 pages).

Chinese Office Action dated Dec. 2, 2014 issued in corresponding Chinese Patent Appln. No. 201080061079.9 with English translation (20 pages).

* cited by examiner

GAS CIRCUIT BREAKER

TECHNICAL FIELD

The present invention relates to gas circuit breakers, particularly a gas circuit breaker used for introducing and interrupting operating current and overcurrent at an electrical power plant, electric power substation and other electric energy supplying apparatuses.

BACKGROUND ART

Conventional art related to a gas circuit breaker for arc extinguishing by blowing arc-extinguishing gas to the arc generated between contacts when electric power is interrupted is disclosed in Japanese Patent Laying-Open No. 2002-203463 (PTL 1), for example. This publication of Japanese Patent Laying-Open No. 2002-203463 (PTL 1) discloses that one annular gap originating from an edge abutting against an electrically insulative cover member and having a wedge-shaped cross section which is open in the radial direction is formed between the abutting face and the insulative cover member, and that the edge is dielectrically shielded by an annular bead surrounding the abutting face.

CITATION LIST

Patent Literature

PTL 1: Japanese Patent Laying-Open No. 2002-203463

SUMMARY OF INVENTION

Technical Problem

Components constituting a gas circuit breaker will be damaged by the repetitive interruption of current. Particularly the aforementioned cover member is worn at the surface in contact with the arc discharge cavity due to the hot gas of the arc generated at the arc discharge cavity. The edge of the cover member is also worn. Accordingly, the cover member is not properly positioned relative to the abutting face, and the width of a flow gap becomes larger as a function of approaching the central axis, leading to a lower flow velocity of the gas flowing from the heating chamber to the arc discharge cavity.

When the damage of the cover member at the surface in contact with the arc discharge cavity becomes significant, the opening of the flow gap at the central axis side will be located farther away from the central axis, leading to a weaker blow of gas to the arc at the arc discharge cavity.

In view of the foregoing, a main object of the present invention is to provide a gas circuit breaker avoiding change in the position of a cover member even when the surface of the cover member in contact with an arc discharge cavity is damaged, and without weakening of the blow of gas to the arc at the arc discharge cavity.

Solution to Problem

A gas circuit breaker according to the present invention includes a stationary contact, a holder attached to the stationary contact, and extending towards a path of arc-extinguishing gas that extinguishes an arc, and an electrically insulative cover member attached to the holder.

Advantageous Effects of Invention

According to the gas circuit breaker of the present invention, the change in the position of the cover member can be suppressed even if the surface of the cover member in contact with the arc discharge cavity is damaged, and weakening of the flow of gas to the arc at the arc discharge cavity can be suppressed.

DESCRIPTION OF EMBODIMENTS

Figure 1:
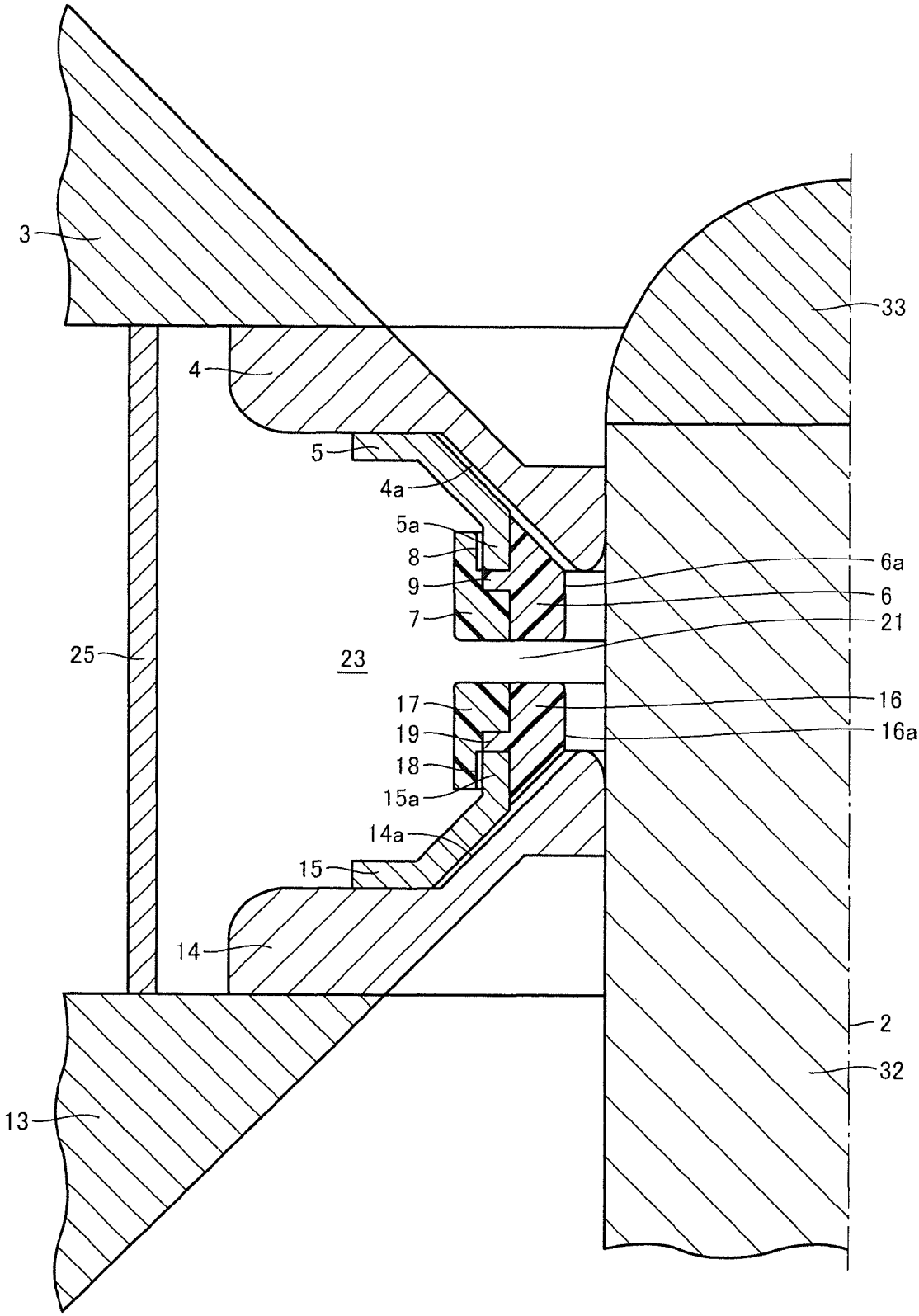
FIG. 1 is a partial sectional view of gas circuit breaker according to a first embodiment.

Embodiments of the present invention will be described hereinafter with reference to the drawings. In the drawings, the same or corresponding elements have the same reference characters allotted, and description thereof will not be repeated.

First Embodiment

FIG. 1 is a partial sectional view of the gas circuit breaker according to a first embodiment. FIG. 1 represents a cross section of a quenching chamber of a gas circuit breaker, i.e. components in a housing not shown, filled with insulating gas. The gas circuit breaker is incorporated in a housing defining a quenching chamber. The gas circuit breaker of the first embodiment is formed substantially rotationally symmetric about a central axis 2 that is the line of axis. An upper holding member 3 and a lower holding member 13 that are hollow holding members are arranged around and centered about central axis 2. Holding members 3 and 13 constituting a pair are arranged spaced apart from each other in the direction along central axis 2 (vertical direction in FIG. 1; referred to as "direction of axis" in the present specification).

Holding members 3 and 13 support an upper contact ring 4 and a lower contact ring 14 constituting one pair of contact rings at the side of the surface of the pair of holding members 3 and 13 facing each other. Contact rings 4 and 14 are made of an anti-consumable metal material, formed taking a funnel shape relative to the direction of axis. In other words, rings 4 and 14 constituting a pair are formed such that the distance therebetween becomes smaller as a function of approaching central axis 2. Upper contact ring 4 that is a stationary contact takes a funnel shape that becomes smaller in the direction coming closer to lower contact ring 14. Lower contact ring 14 that is the other stationary contact takes a funnel shape that becomes smaller in the direction coming closer to upper contact ring 4.

Contact rings 4 and 14 are arranged spaced apart from each other in the direction of axis, centered about central axis 2. Contact rings 4 and 14 are formed in a hollow annular shape. Contact rings 4 and 14 shown in FIG. 1 are members of a fixed rigid body without elastic deformation. It is to be noted that contact rings 4 and 14 may be members allowing elastic deformation, having a plurality of slits formed radially relative to central axis 2. In other words, contact rings 4 and 14 are provided as members that are fixed or that allow elastic deformation.

Inside annular contact rings 4 and 14 is provided a movable contact 32 that can move in the direction of axis. Movable contact 32 includes a tip 33 made of burning-resistant material such as Cu—W, graphite, CFC, graphite/Cu or CFC/Cu, for example.

Movable contact 32 can slide along central axis 2 by an open/close driving device not shown. Movable contact 32 moves in the direction of axis between a connected position in which contact rings 4 and 14 form contact with the outer side face of movable contact 32, and a disconnected position in which contact rings 4 and 14 are separated from movable contact 32. The contacting faces of contact rings 4 and 14 towards central axis 2 are brought into contact with the outer face of movable contact 32 in the connected position.

Contact rings 4 and 14 are connected to first and second electrical terminals not shown via holding members 3 and 13, respectively. Movable contact 32 is connected to the second electrical terminal not shown.

Electrical connection and disconnection of contact rings 4 and 14 are effected by movable contact 32 moving along the direction of axis between the connected position and disconnected position. When movable contact 32 moves to the connected position, contact rings 4 and 14 are connected with movable contact 32 to be conductive, whereby the gas circuit breaker attains a powered-on state. When movable contact 32 moves to a disconnected state, contact rings 4 and 14 are separated from movable contact 32, whereby the gas circuit breaker attains an interrupted state.

Figure 3:
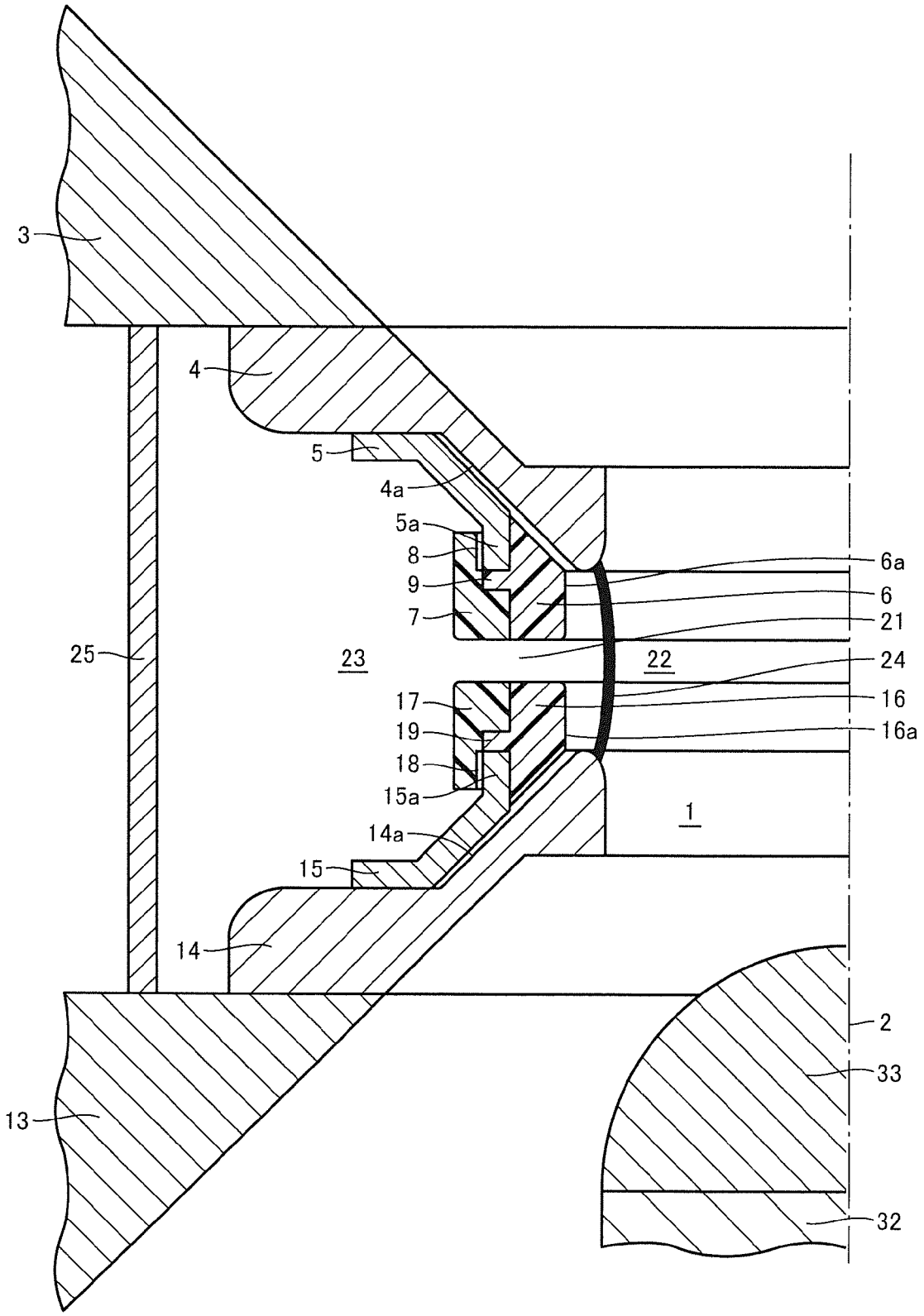
FIG. 3 is a partial sectional view of a gas circuit breaker in an interrupted state.

FIG. 1 represents the gas circuit breaker in a powered-on state corresponding to movable contact 32 at a connected position. The gas circuit breaker in an interrupted state corresponding to movable contact 32 at a disconnected state is shown in FIG. 3 described afterwards. When contact rings 4 and 14 are formed to allow elastic deformation, contact rings 4 and 14 may be deformed elastically at the time of connection or disconnection to and from movable contact 32.

Upper contact ring 4 has an upper mutually-facing surface 4*a*. Upper mutually-facing surface 4*a* is a region in the surface of upper contact ring 4, facing lower contact ring 14 (the portion facing downward in FIG. 1). Lower contact ring 14 has a lower mutually-facing surface 14*a*. Lower mutually-facing surface 14*a* is a region in the surface of lower contact ring 14, facing upper contact ring 4 (the portion facing upward in FIG. 1). Mutually-facing surfaces 4*a* and 14*a* are formed as the face where one of rings 4 and 14 constituting a pair face the other of contact rings 4 and 14.

Since contact rings 4 and 14 opposite to each other are formed to take a funnel shape, mutually-facing surfaces 4*a* and 14*a* are partially inclined relative to the radial direction such that mutually-facing surfaces 4*a* and 14*a* come closer to each other as a function of approaching central axis 2. As used herein, the radial direction is the direction orthogonal to the aforementioned direction of axis, corresponding to the direction extending radially about central axis 2, depicted as the horizontal direction in FIG. 1. Mutually-facing surfaces 4*a* and 14*a* constitute the outer side face in the radial direction of contact rings 4 and 14 (the side farther away from central axis 2).

An upper holder 5 that is a metal holder is attached to upper mutually-facing surface 4*a*. A lower holder 15 that is another metal holder is attached to lower mutually-facing surface 14*a*. Holders 5 and 15 are arranged along mutually-facing surfaces 4*a* and 14*a* of contact rings 4 and 14, respectively, and include fixed ends secured to contact rings 4 and 14 and leading ends 5*a* and 15*a* as free ends, bent conforming to the direction of axis and extending towards the other of contact rings 4 and 14.

Between the slope of each of mutually-facing surfaces 4*a* and 14*a* inclined relative to the radial direction and each of holders 5 and 15 is defined a gap conforming to the slope and corresponding to the tolerable displacement at the time of elastic deformation of contact rings 4 and 14. At the outer circumferential face towards the outer side in the radial direction of leading ends 5*a* and 15*a* of holders 5 and 15, screw sections 8 and 18 are formed.

At leading end 5*a* of holder 5 are attached a first cover member 6 as a first member and a second cover member 7 as a second member. First cover member 6 and second cover member 7 are attached integrally to leading end 5*a* of upper holder 5, constituting upper cover members 6 and 7 on the part of upper holder 5 (the side of upper contact ring 4). First and second cover members 6 and 7 are attached to leading end 5*a* of upper holder 5.

At leading end 15*a* of holder 15 are attached a first cover member 16 as a third member and a second cover member 17 as a fourth member. First cover member 16 and second cover member 17 are attached integrally to leading end 15*a* of lower holder 15, constituting lower cover members 16 and 17 as the other cover members on the part of lower holder 15 (the side of lower contact ring 14). First cover member 16 and second cover member 17 are attached to leading end 15*a* of lower holder 15.

The cover member (both upper cover members 6 and 7 and lower cover members 16 and 17) is an insulating member formed annularly of an electrically insulative material, attached to holders 5 and 15 so as to cover leading ends 5*a* and 15*a*. The cover member includes first cover member 6 that is the first member and first cover member 16 that is the third member, provided at the side closer to central axis 2 in the radial direction, and second cover member 7 that is the second member and second cover member 17 that is the fourth member, provided at the side farther away from central axis 2 in the radial direction. The cover members are attached to contact rings 4 and 14 by means of holders 5 and 15.

Between upper cover members 6, 7 on the part of upper holder 5 fastened to upper contact ring 4 and lower cover members 16, 17 on the part of lower holder 15 fastened to lower contact ring 14 is defined a gap 21 extending in the circumferential direction about central axis 2. Gap 21 separates upper cover members 6 and 7 from lower cover members 16 and 17 in the direction of axis. Lower contact ring 14 is arranged relative to upper contact ring 4 with gap 21 therebetween. Upper holder 5 extends from upper contact ring 4 towards gap 21. Lower holder 15 extends from lower contact ring 14 towards gap 21.

Cover members 6 and 7 on the part of upper holder 5 and cover members 16 and 17 on the part of lower holder 15 are arranged to align in the direction of axis, defining gap 21 therebetween in the direction of axis, opposite to each other through gap 21. Cover members 6, 7, 16 and 17 are arranged such that second cover members 7 and 17 facing gap 21 determine the dimension of gap 21 in the direction of axis, and that first cover members 6 and 16 face an arc discharge cavity 22 that will be described afterwards.

The cover members are arranged so as to partially cover mutually-facing surfaces 4*a* and 14*a* of contact rings 4 and 14. The cover member may be formed in a larger size to cover the entirety of mutually-facing surfaces 4*a* and 14*a*. The cover member may be formed to cover at least a portion of mutually-facing surfaces 4*a* and 14*a* facing each other.

Projections 9 and 19 are formed at first cover members 6 and 16, respectively. A screw section is formed at each of second cover members 7 and 17. The screw sections of second cover members 7 and 17 are fastened with screw sections 8 and 18 of holders 5 and 15, and projections 9 and 19 of first cover members 6 and 16 are fitted into recesses formed by holders 5 and 15 and second cover members 7 and 17, respectively. Thus, cover members divided into two are attached integrally to each of holders 5 and 15. Leading ends 5*a* and 15*a* of holders 5 and 15 are covered with the substantially central region of the integral cover members (also referred to as the core regions).

Figure 2:
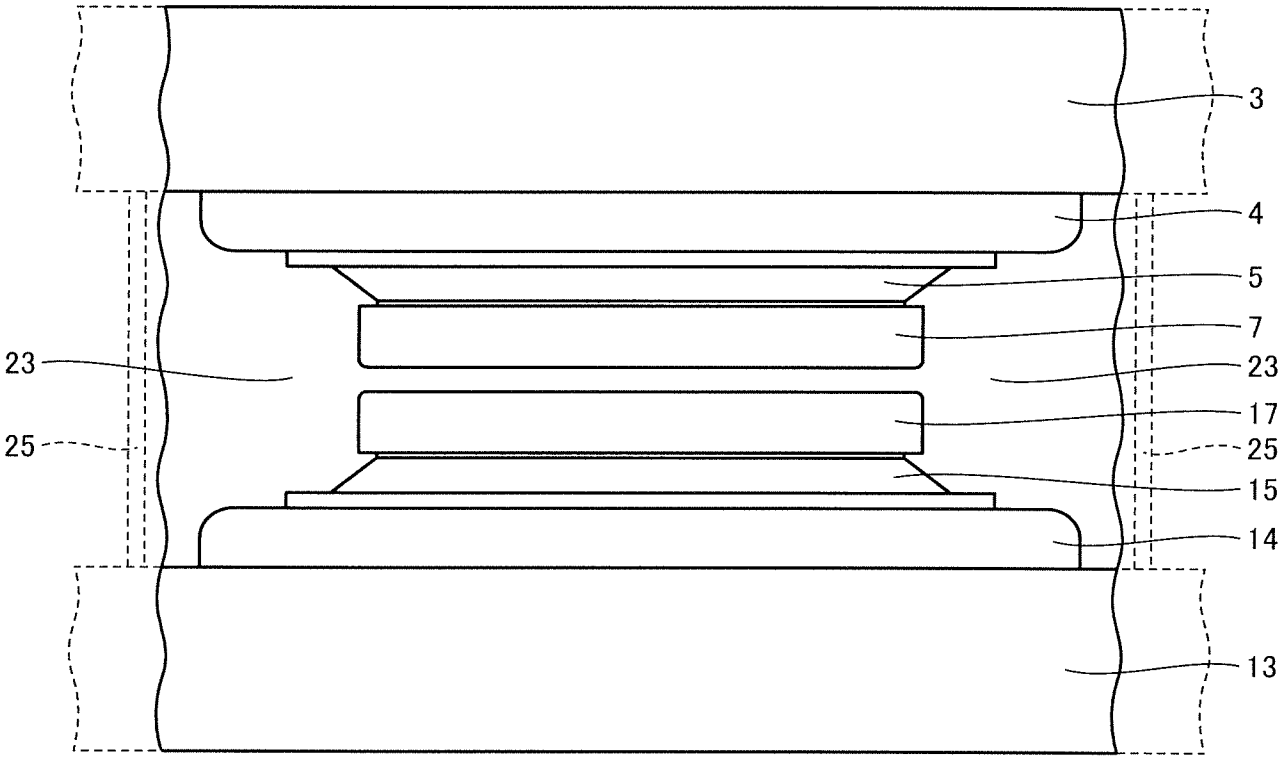
FIG. 2 is a partial side view of a gas circuit breaker.

FIG. 2 is a partial sectional view of the gas circuit breaker. FIG. 2 represents the housing in a partially broken state such that the interior of the gas circuit breaker is viewable from the side of the gas circuit breaker. Movable contact 32 is not depicted in FIG. 2. As shown in FIG. 2, upper holder 5 is located between upper contact ring 4 and second cover member 7. Lower holder 15 is located between lower contact ring 14 and second cover member 17.

Second cover members 7 and 17 are formed in an annular shape having a diameter smaller than that of contact rings 4 and 14. Therefore, as shown in the side view of FIG. 2, the dimension of second cover members 7 and 17 in the radial direction (horizontal direction in the drawing) is smaller than the dimension of contact rings 4 and 14. Second cover members 7 and 17 are located at the outer side of first cover members 6 and 16 in the radial direction (refer to FIG. 1). Therefore, in the side view of FIG. 2, only second cover members 7 and 17 are discernible. First cover members 6 and 16 are not shown since they are not discernible.

An operation of the gas circuit breaker based on the configuration set forth above will be described hereinafter. FIG. 3 is a partial sectional view of the gas circuit breaker in an interrupted state. The contact region 1 of the arc-extinguishing gas and arc shown in FIG. 3 is formed in the quenching chamber in which the gas circuit breaker is incorporated, and arranged rotationally symmetric about central axis 2, defined in the cavity surrounded by contact rings 4 and 14. Upper cover members 6 and 7 include first cover member 6 located at the side in proximity to contact region 1, and second cover member 7 located at the side farther away from contact region 1. Lower cover members 16 and 17 include first cover member 16 located at the side in proximity to contact region 1, and second cover member 17 located at the side farther away from contact region 1.

Referring to FIG. 1 showing the gas circuit breaker in a conductive state, movable contact 32 is located at the connected position in the proximity of contact rings 4 and 14 centered about central axis 2 in an electrically connected state, and connected with contact rings 4 and 14 attaining a conductive state. The shift of movable contact 32 along the direction of axis in contact region 1 from the connected position to the disconnected position causes the gas circuit breaker to attain the interrupted state shown in FIG. 3 from the powered-on state.

When upper contact ring 4 and movable contact 32 do not form contact by the shift of movable contact 32, an arc is generated between upper contact ring 4 and tip 33 of movable contact 32. When movable contact 32 further moves such that lower contact ring 14 and movable contact 32 are no longer in contact, the aforementioned arc changes its direction from tip 33 of movable contact 32 to lower contact ring 14. Thus, arc 24 shown in FIG. 3 is generated at arc discharge cavity 22 between contact rings 4 and 14 in contact region 1.

The gas in arc discharge cavity 22 is heated by arc 24 to attain a high temperature, whereby the pressure in arc discharge cavity 22 becomes higher. The pair of contact rings 4 and 14 is provided as two consumable contacts, worn by high-temperature arc 24.

In the gas circuit breaker of the present embodiment, gap 21 is formed as a ring between upper cover members 6, 7 and lower cover members 16, 17. This gap 21 functions as a flow gap allowing the gas attaining high temperature to flow radially outwards from arc discharge cavity 22 towards annular heating chamber 23 outside contact region 1. Heating chamber 23 has its perimeter surrounded by a partition wall 25. The arc-extinguishing gas that extinguishes arc 24 is pressurized in heating chamber 23 when an arc is generated. When the arc is extinguished, the arc-extinguishing gas flows radially inwards that is the opposite direction through gap 21 into arc discharge cavity 22 in contact region 1. Gap 21 that is a passage of the arc-extinguishing gas is defined by cover members 6, 7, 16 and 17. Gap 21 constitutes the heat puffer blowout opening of the gas circuit breaker. Communication is established between heating chamber 23 and arc discharge cavity 22 via gap 21.

The arc-extinguishing gas passes through gap 21 from heating chamber 23 into arc discharge cavity 22 where arc-extinguishing gas is blown against arc 24 to extinguish the same. By the hot gas attaining high temperature in arc discharge cavity 22 and the radiated energy from arc 24 at this stage, the temperature of first cover members 6 and 16 rises to cause damage thereof. Particularly, inner diameter faces 6*a* and 16*a* of first cover members 6 and 16 are worn significantly. Evaporation loss of a portion of first cover members 6 and 16 causes the gas pressure in arc discharge cavity 22 to further rise.

According to the present embodiment, the substantially central region of the cover member that is an integral body of first cover members 6, 16 and second cover members 7, 17 is held by metal holders 5 and 15. Since holders 5 and 15 made of metal has high degree of elasticity and low heat distortion (heat expansion), displacement or deformation of holders 5 and 15 can be suppressed even if the temperature of cover members 6, 7, 16 and 17 rises. Accordingly, position change, deformation or the like of the cover members attached to holders 5 and 15 can be suppressed. Therefore, the width of gap 21 formed between upper cover members 6, 7 and lower cover members 16, 17 can be maintained constant.

If the width of gap 21 serving as the flow gap becomes wider, the flow velocity of arc-extinguishing gas flowing into arc discharge cavity 22 via gap 21 will become lower, leading to degradation in the arc extinguishing capability. Since the width of the flow gap is maintained constant by virtue of cover members 6, 7, 16 and 17 in the gas circuit breaker of the present embodiment, the flow velocity of arc-extinguishing gas flowing into arc discharge cavity 22 via gap 21 can be maintained. Thus, reduction in the arc extinguishing capability of the arc-extinguishing gas can be suppressed.

Since the gas circuit breaker of the first embodiment has the core region of the cover member supported by metal holders 5 and 15 having high degree of elasticity and low heat distortion (heat expansion) as described above, deformation of the cover member caused by hot gas of arc discharge cavity 22 can be suppressed even if first cover members 6 and 16 in contact with arc discharge cavity 22 are damaged. In the case where iron is employed for holders 5, 15, for example, the degree of elasticity is equal to or greater than 100 times that of Teflon (registered trademark), and greater than or equal to 10 times that of nylon. Although the heat distortion temperature of Teflon (registered trademark) and nylon is as low as approximately a hundred and several ten degrees, the heat distortion (heat expansion) of iron is approximately 10% that of Teflon and nylon based on the same temperature increase.

Second Embodiment

Figure 4:
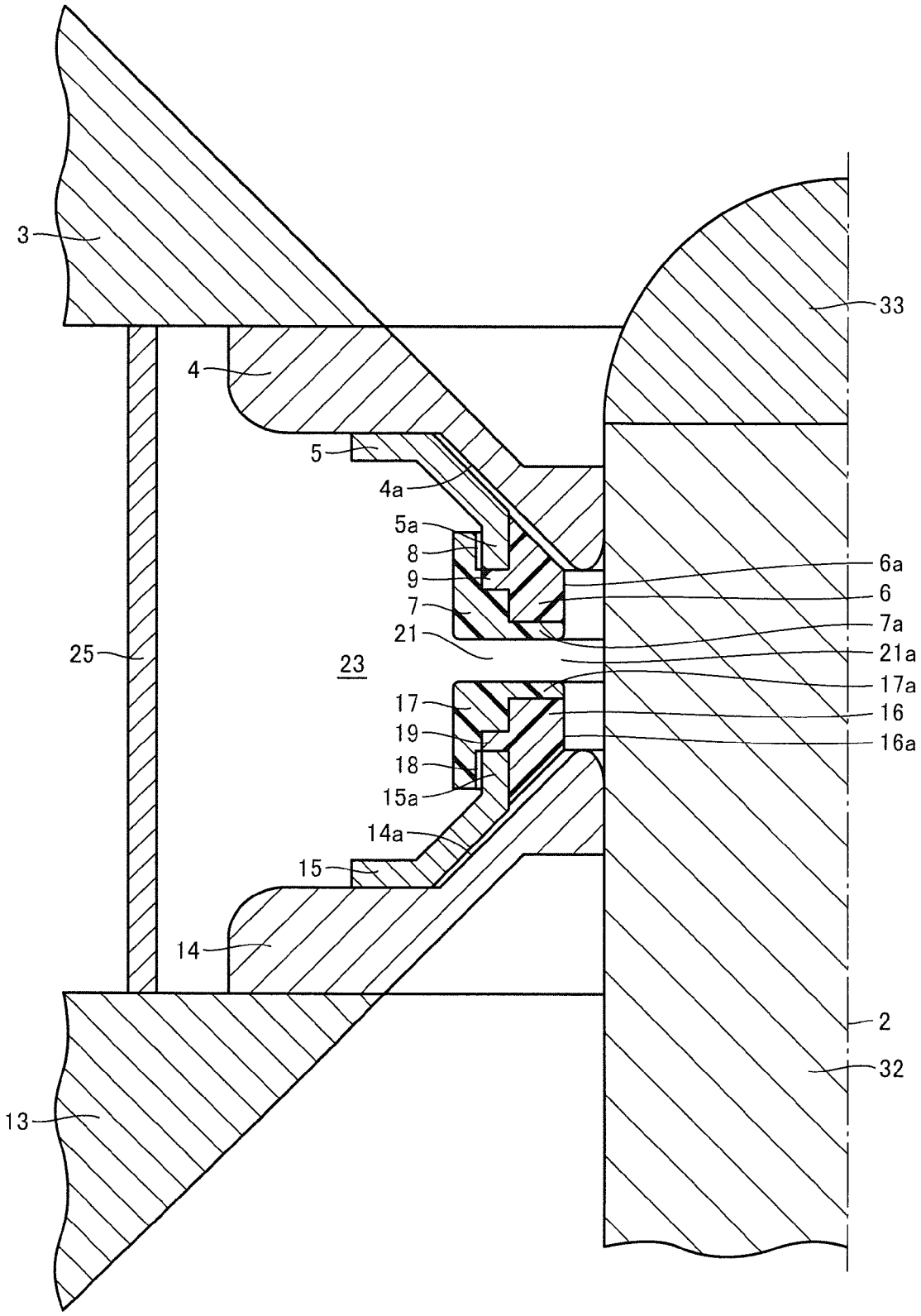
FIG. 4 is a partial sectional view of a gas circuit breaker according to a second embodiment of the present invention.

FIG. 4 is a partial sectional view of a gas circuit breaker according to a second embodiment. FIG. 4 represents a cross section of main components in a quenching chamber of another gas circuit breaker in a powered-on state. The gas circuit breaker of the second embodiment and the gas circuit breaker of the first embodiment set forth above basically have a similar configuration. The second embodiment differs from the first embodiment in that the cover members take the configuration shown in FIG. 4.

Specifically, in the context of a pair of cover members defining gap 21 therebetween as shown in FIG. 4, the entire surface of the cover member facing gap 21 is formed of second cover member 7 that is the second member and second cover member 17 that is the fourth member. Second cover members 7 and 17 of the second embodiment include extensions 7*a* and 17*a* having the surface side that faces gap 21 extending to the inner side in the radial direction (the direction approaching central axis 2). By forming a surface facing gap 21 between the cover members by means of extensions 7*a* and 17*a*, gap 21 is defined by second cover members 7 and 17. Second cover members 7 and 17 that are the divided cover members located at the outer circumferential side constitute the surfaces of the pair of cover members facing each other.

The cover member is divided into second cover members 7 and 17 defining gap 21 and first cover members 6 and 16 that are the regions in contact with arc discharge cavity 22. First cover members 6 and 16 are consumed and vaporized by the arc to also serve to increase the pressure at arc discharge cavity 22. Therefore, they are made of a material that is readily evaporated to some degree. In contrast, second cover members 7 and 17 do not serve to increase the pressure at arc discharge cavity 22 as much as first cover members 6 and 16. Therefore, first cover members 6 and 16 may be formed of a material differing from that of second cover members 7 and 17. Specifically, second cover members 7 and 17 defining gap 21 may be formed of an insulating material of high heat resistance that is less consumable than first cover members 6 and 16.

As such, extensions 7*a* and 17*a* of second members 7 and 17 are less consumable by the hot gas even if inner diameter faces 6*a* and 16*a* of first cover members 6 and 16 are significantly consumed by the hot gas attaining high temperature in arc discharge cavity 22 and/or the radiated energy from the arc. Therefore, the width and length of gap 21 can be maintained substantially constant since the deformation of second cover members 7 and 17 defining gap 21 is suppressed.

When the pressurized gas flows from heating chamber 23 into arc discharge cavity 22 via gap 21 in an arc extinguishing mode, the flow velocity of the arc-extinguishing gas becomes lower as a function of distance from gap 21. By the configuration of providing extensions 7*a* and 17*a* set forth above, a flow of arc-extinguishing gas at a high flow velocity is blown to the proximity of the arc. In other words, gap 21 constituting the path of the arc-extinguishing gas flowing into arc discharge cavity 22 can be ensured up to the proximity of the arc, and the distance between the outlet from which arc-extinguishing gas is blown out from gap 21 and the arc can be maintained small. Therefore, arc-extinguishing gas in higher speed can be blown towards the arc. Thus, the arc extinguishing performance by the arc-extinguishing gas can be improved.

Since the gas circuit breaker of the second embodiment has the core region of the cover members supported by metal holders 5 and 15 with high degree of elasticity and low heat distortion (heat expansion), likewise with the first embodiment as set forth above, deformation of the cover member caused by the hot gas in arc discharge cavity 22 can be suppressed, allowing reduction in the arc extinguishing capability by the arc-extinguishing gas to be suppressed. In addition, second cover members 7 and 17 defining gap 21, among the core region of the divided cover members, are formed of a material of high heat resistance to suppress damage at second cover members 7 and 17 caused by the hot gas. This provides the advantage that the blowing of gas to the arc is not weakened since the opening of gap 21 at the side of arc discharge cavity 22 is less likely to be positioned farther away from central axis 2.

Third Embodiment

Figure 5:
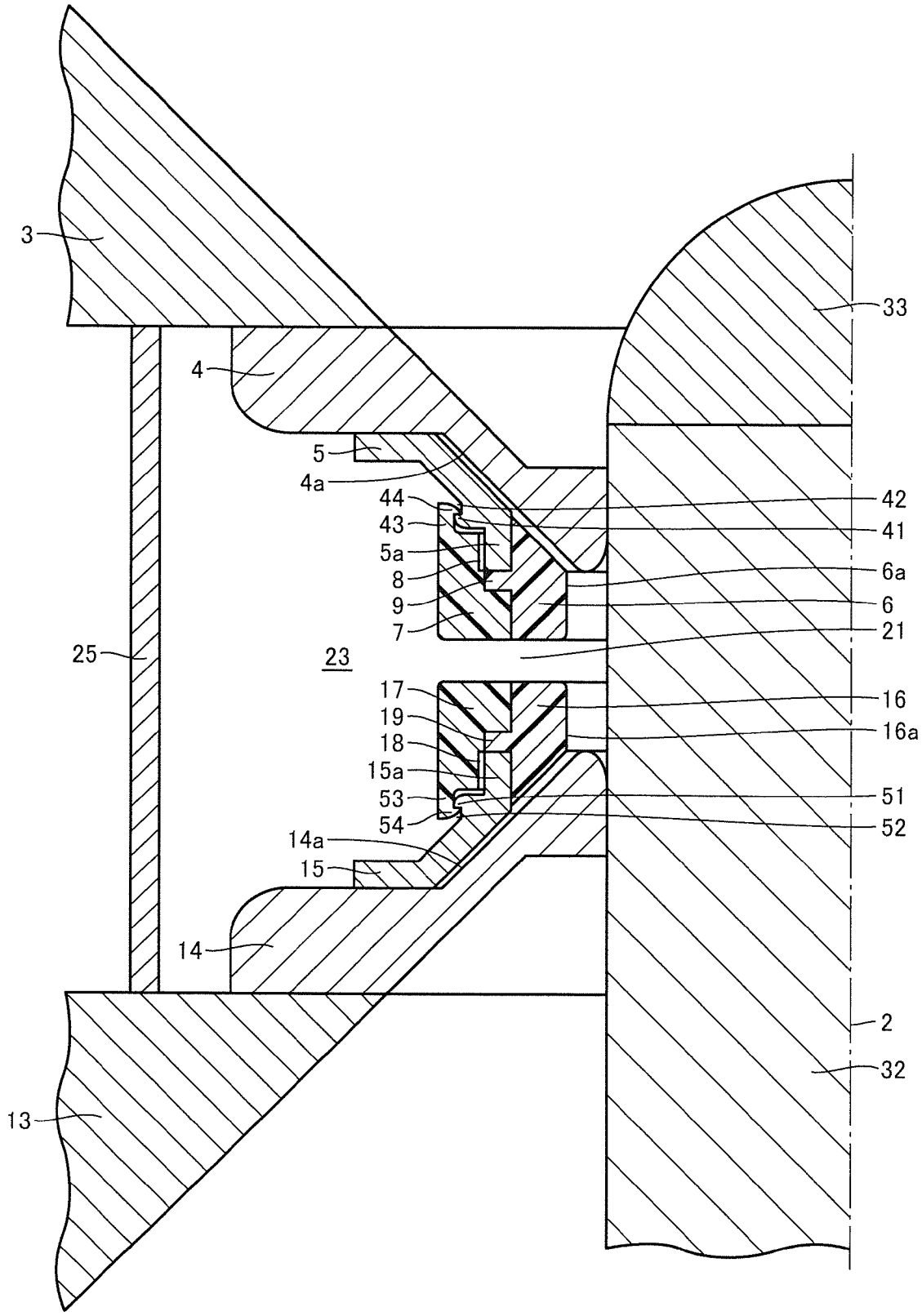
FIG. 5 is a partial sectional view of a gas circuit breaker according to a third embodiment of the present invention.

FIG. 5 is a partial sectional view of a gas circuit breaker according to a third embodiment. Although the plurality of members constituting the cover member may be coupled integrally by means of screw sections 8 and 18 and projections 9 and 19, as described in the first and second embodiments, the cover members may be coupled integrally employing another arbitrary method.

Specifically, as shown in FIG. 5, elongate sections 43 and 53 are provided at a portion of second cover members 7 and 17, extending to project towards holders 5 and 15. Projections 44 and 54 are formed at the inner circumferential face of elongate sections 43 and 53 at the inner side in the radial direction corresponding to the surface of the side that faces holders 5 and 15. Furthermore, protrusions 41 and 51 thrusting out towards elongate sections 43 and 53 are provided at a portion of the outer circumferential face of holders 5 and 15 at the side that faces elongate sections 43 and 53. Engagement grooves 42 and 52 are formed at protrusions 41 and 51 such that the outer circumferential face of protrusions 41 and 51 are partially recessed in the radial direction.

When the screw sections of second cover members 7 and 17 are to be fastened with screw sections 8 and 18 of holders 5 and 15 in the gas circuit breaker of the third embodiment based on the above-described configuration, second cover members 7 and 17 are screwed in with elongate sections 43 and 53 under elastic deformation, allowing engagement by fitting projections 44 and 54 into engagement grooves 42 and 52.

Accordingly, loosening of the screw fastening between the screw sections of second cover members 7 and 17 and screw sections 8 and 18 of holders 5 and 15 can be suppressed. Therefore, separation between first cover members 6 and 16 and second cover members 7 and 17 constituting the cover member can be suppressed. The screw sections of second cover members 7 and 17 and screw sections 8 and 18 of holders 5 and 15 may be omitted to allow the plurality of members constituting the cover member to be attached only by the engagement between projections 44 and 54 provided at elongate sections 43 and 53 and engagement grooves 42 and 52.

Fourth Embodiment

Figure 6:
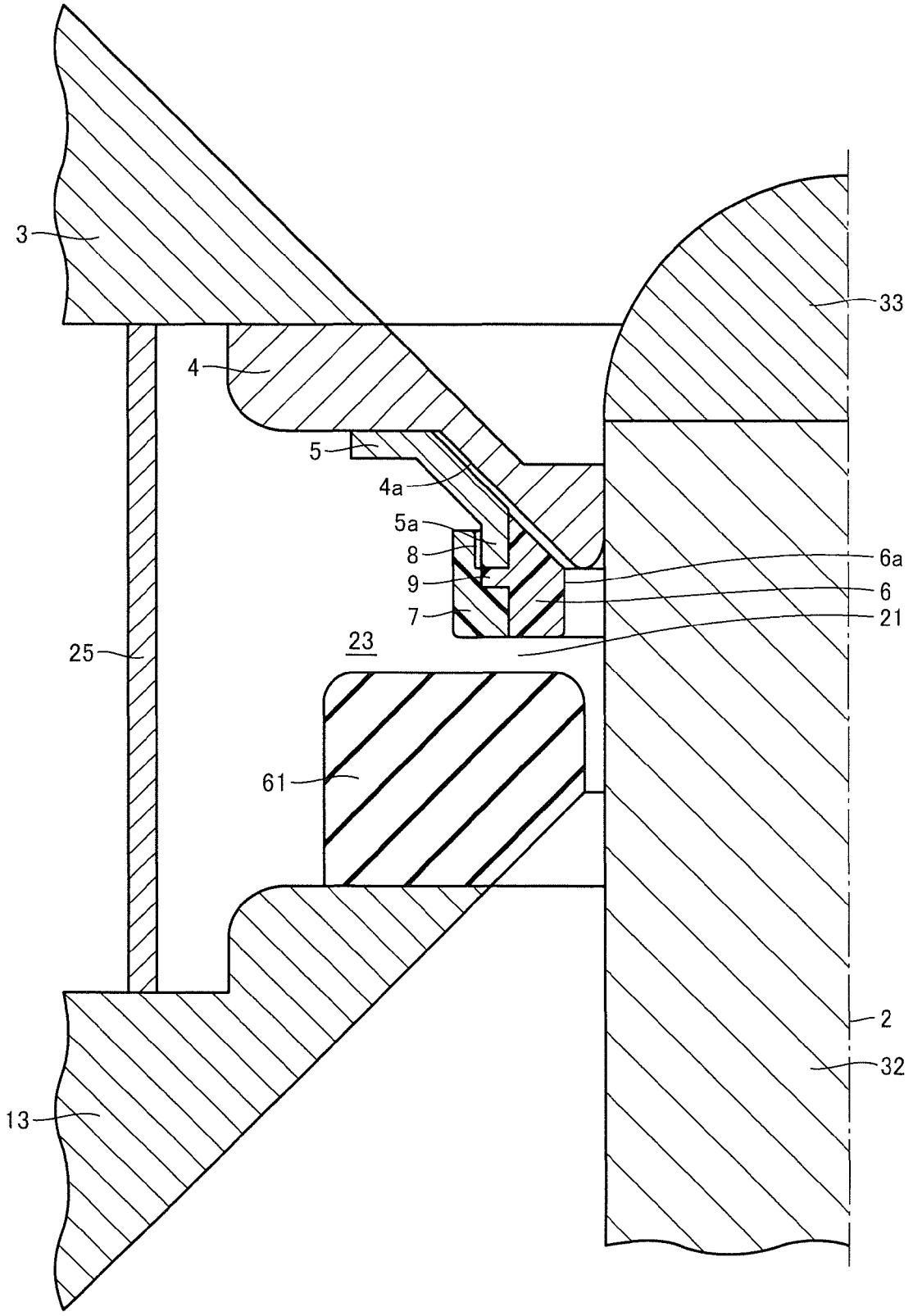
FIG. 6 is a partial sectional view of a gas circuit breaker according to a fourth embodiment of the present invention.

FIG. 6 is a partial sectional view of a gas circuit breaker according to a fourth embodiment. The first to third embodiments have been described based on an exemplified gas circuit breaker including upper and lower contact rings 4 and 14 constituting a pair of stationary contacts, upper and lower holders 5 and 15 constituting a pair of holders, and upper cover members 6, 7 and lower cover members 16, 17 constituting a pair of cover members. The gas circuit breaker of the present invention is not limited to such a configuration. In other words, the gas circuit breaker of the present invention does not necessarily have to include a pair of stationary contacts.

Specifically, as shown in FIG. 6, a gas circuit breaker including contact ring 4, holder 5, and cover members 6 and 7 at only one side instead of the pair of contact rings, holders, and cover members described in detail in the first embodiment may be provided. Such a gas circuit breaker further includes an insulating member 61 that is electrically insulative. Gap 21 is defined between cover members 6, 7 and insulating member 61 in the direction of axis. Insulating member 61 is arranged to face each of cover members 6, 7 with gap 21 therebetween.

The inner circumferential face of annular insulating member 61 is located at a side outer than the inner circumferential face of contact ring 4 in the radial direction. Insulating member 61 is formed such that the inner circumferential face corresponds to a diameter greater than that of contact ring 4. In the conductive state shown in FIG. 6, contact ring 4 forms contact with the outer circumferential face of movable contact 32, whereas insulating member 61 does not form contact with movable contact 32. Thus, there is provided a configuration in which the shift of movable contact 32 is not impeded by insulating member 61, and the surface area of the stationary contact sliding against to the outer circumferential face of movable contact 32 is smaller as compared to the first embodiment.

As described in the first embodiment, contact ring 4 is connected to a first electrical terminal not shown, and movable contact 32 is connected to a second electrical terminal not shown. Therefore, when movable contact 32 shown in FIG. 6 is located at a connected position, contact ring 4 is brought into contact with movable contact 32 to establish a conductive state therebetween, whereby the gas circuit breaker attains a powered-on state. In other words, by contact ring 4 connected to a first electrical terminal differing from the second electrical terminal to which movable contact 32 is connected, the gas circuit breaker can be set at a powered-on state.

Figure 7:
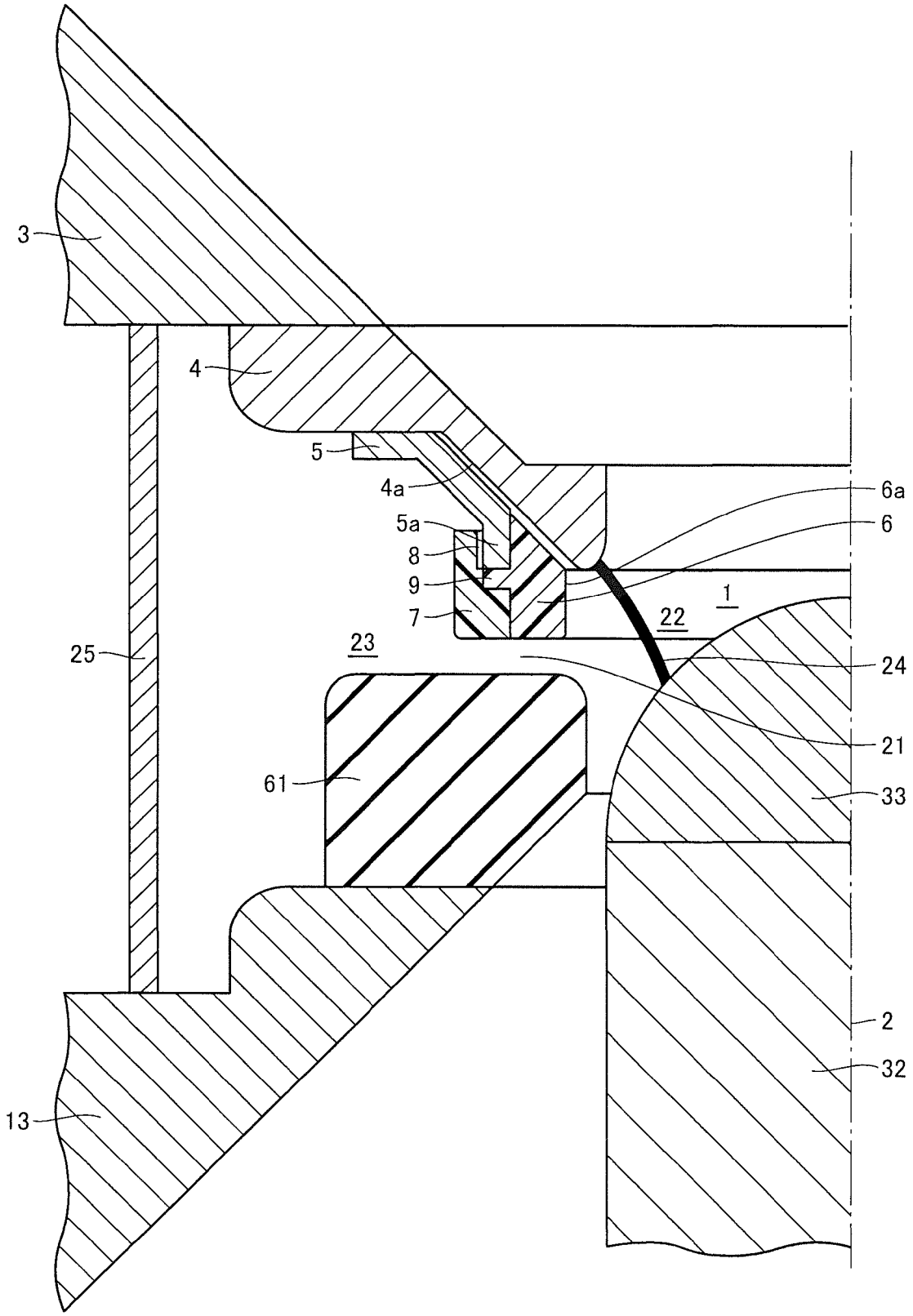
FIG. 7 is a partial sectional view of a gas circuit breaker in an interrupted state according to the fourth embodiment of the present invention.

FIG. 7 is a partial sectional view of the gas circuit breaker in an interrupted state of the fourth embodiment. By the shifting of movable contact 32 along the direction of axis from the connected position to the disconnected position in contact region 1, the gas circuit breaker attains an interrupted state shown in FIG. 7 from the powered-on state shown in FIG. 6. When upper contact ring 4 does not form contact with movable contact 32 by the shifting of movable contact 32, an arc is generated between upper contact ring 4 and tip 33 of movable contact 32. Thus, an arc 24 shown in FIG. 7 is generated at arc discharge cavity 22 between contact ring 4 and movable contact 32 in contact region 1.

In an arc extinguishing mode, the arc-extinguishing gas flows through gap 21 into arc discharge cavity 22 in contact region 1. Arc 24 is extinguished by being blown out by the arc-extinguishing gas flowing from heating chamber 23 to arc discharge cavity 22 through gap 21. Since position change, deformation or the like of cover members 6 and 7 attached to holder 5 can be suppressed, likewise with the first embodiment, the width of gap 21 formed between cover members 6, 7 and insulating member 61 can be maintained constant. Therefore, the flow velocity of arc-extinguishing gas flowing into arc discharge cavity 22 via gap 21 can be maintained, allowing suppression in the reduction of the arc extinguishing capability of the arc-extinguishing gas.

The gas circuit breaker of the fourth embodiment has the number of contact ring 4, holder 5 and cover members 6 and 7 reduced, as compared to the first to third embodiments. The fabrication cost of the gas circuit breaker can be reduced by virtue of a simple configuration having the number of components of the gas circuit breaker reduced.

The first to fourth embodiments have been described based on an example in which the cover members divided into two are held by leading ends 5*a* and 15*a* of holders 5 and 15. The cover member is not limited to those divided into two. The cover member may be divided into components of a larger number as long as the substantially central region of the cover members coupled integrally is supported by holders 5 and 15.

It is to be understood that the embodiments of the present invention disclosed herein are only by way of example, and not to be taken by way of limitation. The scope of the present invention is not limited by the description above, but rather by the terms of the appended claims, and is intended to include any modifications within the scope and meaning equivalent to the terms of the claims.

REFERENCE SIGNS LIST

1 contact region; 2 central axis; 3, 13 holding member; 4, 14 contact ring; 4*a*, 14*a* mutually-facing surface; 5, 15 holder; 5*a*, 15*a* leading end; 6, 16 first cover member; 6*a*, 16*a* inner diameter face; 7, 17 second cover member; 7*a*, 17*a* extension; 8, 18 screw section; 9, 19 projection; 21 gap; 22 arc discharge cavity; 23 heating chamber; 24 arc; 25 partition wall; 32 movable contact; 33 tip; 41, 51 protrusion; 42, 52 engagement groove; 43, 53 elongate section; 44, 54 projection; 61 insulating member.

The invention claimed is:

1. A gas circuit breaker comprising:

a stationary contact, a holder attached to said stationary contact, and extending towards a path of arc-extinguishing gas extinguishing an arc, and an electrically insulative cover member attached to said holder, wherein said cover member includes a first member located at a side in proximity to a contact region between the arc-extinguishing gas and arc, and a second member located at a side farther away from said contact region, said first member and said second member being attached to said holder integrally.

2. The gas circuit breaker according to claim 1, wherein an entirety of a surface of said cover member facing said path is formed by said second member.

3. The gas circuit breaker according to claim 1, wherein said second member is made of a material having heat resistance higher than the heat resistance of said first member.

4. A gas circuit breaker comprising:

an annular stationary contact having an axis at its center, a holder attached to said stationary contact, and extending towards a path of arc-extinguishing gas extinguishing an arc, an electrically insulative cover member attached to said holder, said cover member covering a surface of said holder that faces said axis; and an insulating member that is electrically insulative, arranged to face said cover member with said path therebetween.

5. The gas circuit breaker according to claim 4, further comprising:

another stationary contact arranged relative to said stationary contact with said path therebetween, and another holder attached to said another stationary contact, extending towards said path, wherein said insulating member is attached to said another holder.

6. The gas circuit breaker according to claim 5, wherein said another stationary contact is formed in an annular shape centered about an axis.

7. The gas circuit breaker according to claim 6, wherein said stationary contact and said another stationary contact are arranged spaced apart in a direction of said axis.

8. The gas circuit breaker according to claim 6, wherein said cover member and said insulating member are arranged aligning in the direction of said axis.

9. The gas circuit breaker according to claim 6, wherein a contact region between the arc-extinguishing gas and arc is formed in a cavity surrounded by said another stationary contact.

10. The gas circuit breaker according to claim 9, further comprising a movable contact moving between a connected position and a disconnected position along a direction of said axis, wherein said arc-extinguishing gas passes through said path to flow into said contact region to extinguish an arc generated in said contact region when said movable contact moves from said connected position to said disconnected position.

11. The gas circuit breaker according to claim 5, wherein said another holder is made of metal.

12. The gas circuit breaker according to claim 5, wherein said insulating member covers a leading end of said another holder extending towards said path.

13. The gas circuit breaker according to claim 5, wherein said insulating member includes a third member located at a side in proximity to a contact region between the arc-extinguishing gas and arc, and a fourth member located at a side farther away from said contact region, said third member and said fourth member being attached to said another holder integrally.

14. The gas circuit breaker according to claim 13, wherein an entirety of a surface of said insulating member facing said path is formed by said fourth member.

15. The gas circuit breaker according to claim 13, wherein said fourth member is made of a material having heat resistance higher than the heat resistance of said third member.

16. The gas circuit breaker according to claim 5, wherein said another holder supports a substantially central region of said insulating member.

* * * * *